US005689896A

United States Patent [19]

Smetana

[11] Patent Number: 5,689,896

[45] Date of Patent: Nov. 25, 1997

[54] PULSATOR FOR A HAIR DRYER

[75] Inventor: Norbert Smetana, Kronberg, Germany

[73] Assignee: Braun Aktiengesellschaft, Kronberg, Germany

[21] Appl. No.: 764,348

[22] Filed: Dec. 12, 1996

Related U.S. Application Data

[63] Continuation of PCT/EP95/01855, May 16, 1995.

[51] Int. Cl.[6] ..... A45D 00/00

[52] U.S. Cl. ..... 34/97; 239/505

[58] Field of Search ..... 34/96, 97; 239/503, 239/505, 507, 508; 454/284, 338, 125

[56] References Cited

U.S. PATENT DOCUMENTS

| | | | |
|---|---|---|---|
| 4,132,360 | 1/1979 | Lee | 239/383 |
| 4,151,955 | 5/1979 | Stouffer | 239/11 |
| 4,683,922 | 8/1987 | Harrison et al. | 239/505 |
| 4,735,361 | 4/1988 | Wallace | 239/507 |
| 5,060,398 | 10/1991 | Wolens | 34/90 |
| 5,161,317 | 11/1992 | McDougall | 34/97 |
| 5,471,763 | 12/1995 | McArthur | 34/96 |
| 5,473,824 | 12/1995 | Prehodka | 34/97 |

FOREIGN PATENT DOCUMENTS

| | | | |
|---|---|---|---|
| 1 183 345 | 3/1985 | Canada | A45D 20/00 |
| 0 441 752 A1 | 8/1991 | European Pat. Off. | A45D 20/12 |
| 680978 | 12/1992 | Switzerland | A45D 20/12 |
| 946 685 | 7/1982 | U.S.S.R. | B05B 1/34 |
| 2 268 060 | 1/1994 | United Kingdom | A45D 20/12 |

*Primary Examiner*—Henry A. Bennett
*Assistant Examiner*—D. Doster
*Attorney, Agent, or Firm*—Edward S. Podszus

[57] ABSTRACT

The invention is directed to a pulsator for a hair dryer wherein the air current (2) generated by the hair dryer can be deflected as a function of time. To this end, the hair dryer has a housing accommodating a blower mechanism to generate the air current (2) and possessing an opening to discharge the air current (2). The pulsator is configured as an attachment (1) and includes an inlet opening (3) adapted to be coupled to the opening of the housing, as well as an outlet opening (4). Between the inlet opening (3) and the outlet opening (4) of the attachment (1), wall portions (7, 8, 9, 10) are provided for bounding an inner compartment (6). Captured within the inner compartment (6) is an otherwise freely movable body (13) of approximately spherical shape which can be set in orbital motion approximately transversely to the direction of the air current (2) by the air current (2).

32 Claims, 1 Drawing Sheet

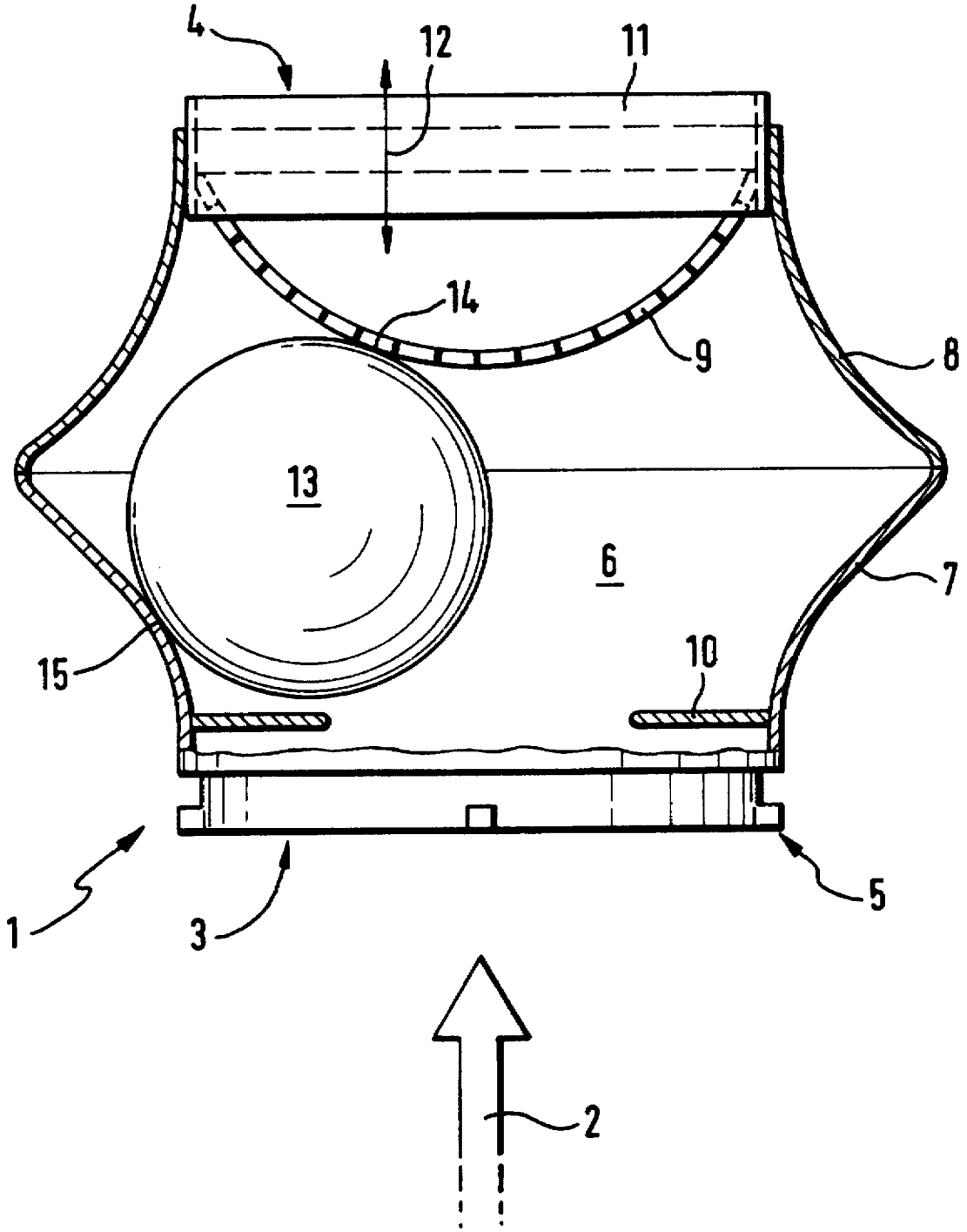
4
12
11
14
9
8
13
6
7
15
10
1
3
5
2

PULSATOR FOR A HAIR DRYER

This is a continuation of International Application No. PCT/EP95/01855, pending, with an international filing date of May 16, 1995.

This invention relates to an attachment, in particular for the deflection of a current of air as a function of time, particularly a pulsator or the like, for an apparatus for the treatment of hair by means of the air current, particularly for a hair dryer or the like, in which the apparatus has a housing accommodating means to generate the air current and possessing an opening to discharge the air current, and in which the attachment includes an inlet opening, which is adapted to be coupled in particular to the opening of the housing, and an outlet opening.

An attachment of this type for a hair dryer is known, for example, from U.S. Pat. No. 4,132,360. This patent is directed to an attachment constructed as a short tube with a propeller-type impeller mounted inside. The axis of rotation is arranged in the longitudinal direction of the tube and hence of the hair dryer's air current, and the impeller is aligned at an angle of approximately 70 degrees to this longitudinal direction. When the hair dryer is switched on, the air current flows through the attachment, setting the impeller in rotation. In this manner, the air current is deflected into a rotating path, resulting in an air current perceived by the user as pulsating. The disadvantage of the known attachment is in particular that the bearing required for the impeller necessitates a considerable manufacturing effort and that the assembly of the known attachment is complicated. As used in the following, pulsation is understood to mean in particular and essentially a deflection, variable with time, of the air current expelled from the hair dryer, or a time-controlled, at least partial interruption of said air current.

It is an object of the present invention to devise an attachment enabling a pulsating current of air to be produced, while the attachment affords greatest possible simplicity of manufacture and assembly.

SUMMARY OF THE INVENTION

This object is accomplished by the present invention essentially in that in an attachment of the type initially referred to wall portions are provided between the inlet opening and the outlet opening of the attachment to bound an inner compartment through which the air current can flow, with an essentially freely movable body of in particular approximately spherical shape being held captive inside the inner compartment.

The spherical body provided in accordance with the present invention does not need any special bearings in the attachment. All the effort for bearings of this type is eliminated. Manufacture and assembly of the attachment are substantially simpler, require less material input and therefore incur reduced cost on the whole. When the hair dryer is switched on, the free movability of the spherical body provided in accordance with the invention results in the body being set in motion by the air current flowing through the inner compartment. This motion causes the air current to be deflected so that an air current variable with time acts on the user. One of the advantages of such an air current is that the hair undergoing treatment is fluffed out and hence can be dried more quickly by the air current. In addition, the need to wave the hair dryer back and forth with the user's hand is eliminated, thus also simplifying manipulation during the drying operation.

Overall, the present invention thus provides an attachment for a hair dryer, which enables the generation of a current of air that is variable with time, without this requiring the special mounting of any component.

In an advantageous further configuration of the present invention, the inner compartment is constructed so that the body inside the inner compartment can be set in an approximately orbital motion by the air current, with the plane formed by the orbit being arranged approximately transversely to the direction of the air current. In the ON-condition of the hair dryer, the orbital motion of the spherical body causes the air current to be displaced in a rotating movement varying with time. This is perceived by the user as agreeable and likewise increases the effect of the air current on the hair to be treated, particularly with a view to a more uniform fluffing of the hair and its faster drying.

In an advantageous configuration of the present invention, the inner compartment is approximately symmetrical about its axis, with the axis of symmetry being arranged essentially in the direction of the air current. This is conducive to the orbital motion of the spherical body. The rotationally symmetric configuration of the inner compartment also affords manufacturing-related advantages.

In a further advantageous configuration of the present invention, the inner compartment is bounded by a screen or the like allowing passage of the air current therethrough and projecting from the outlet opening into the inner compartment in particular with an approximately hemispherical shape. The inner compartment is bounded by the screen in such a way that the spherical body is set in motion even when the flow rate of the air current is low. At the same time, the air permeability of the screen largely prevents the air current from being substantially impeded by the screen. The hemispherical configuration of the screen contributes to the body being set in orbital motion by the air current.

Particularly suitably, the screen is slidable in the direction of the air current, or alternatively, the two half-shells of the attachment are relatively slidable. It is thus possible to decrease or increase in particular the diameter of the orbital motion of the spherical body. This results in an increase or decrease of the body's orbital speed in the inner compartment of the attachment. For the user this means being able to set a faster or slower pulsating frequency of the air current by adjusting the screen correspondingly.

In a further advantageous configuration of the present invention, the inner compartment is bounded by struts or the like configured in particular as a circular ring through which the air current can flow and being arranged in the area of the inlet opening approximately. transversely to the direction of the air current. The struts ensure that the spherical body is reliably held captive inside the inner compartment and cannot fall out by its own accord. At the same time, the air permeability of the struts prevents the air current from being impeded. By making the struts flexible, it is possible in addition for the spherical body to be easily removed as in the event of damage and for it to be replaced by another spherical body.

In an advantageous further configuration of the present invention, the inner compartment is bounded by two shells shaped in particular in the manner of the frustum of a cone or domed in a bell or trumpet-like fashion, approximately, which have in particular their larger circumferences joined together. The shells ensure a rotationally symmetric configuration of the inner compartment, thus effecting in simple manner the previously explained orbital motion of the spherical body. The shells are easy to manufacture and also afford advantages with a view to the design of the attachment. Further cost savings may be realized by making the two shells identical.

In a configuration of the present invention, the wall portions bounding the inner compartment are made of a transparent material, for example, a transparent plastic, and/or the spherical body is colored, in particular by means of thermochromic lacquers. The rotation of the spherical body inside the inner compartment of the attachment is thus rendered visible to the user. This makes it easier for the user to make use of and understand the function of the attachment, for example, with a view to setting the frequency of pulsation of the air current. Further, particularly the use of a thermochromic lacquer for the spherical body results in an attractive appearance of the attachment, the essential advantage of such a lacquer lying in the possibility of indicating the temperature of the emerging hot air, enabling, for example, the signaling of a particularly gentle drying temperature.

The invention may be implemented in two ways. First, it is possible for the opening of the housing and the inlet opening of the attachment to be formed of one piece or be inseparably joined together. In other words, the pulsator is fixedly integrated in the hair dryer. Second, it is possible for the opening of the housing and the inlet opening of the attachment to be separably joined together, for example, by means of a bayonet-type connector or the like. This means that the attachment can be separated from the housing as required. The pulsator can be detached from the hair dryer and the hair dryer can also be operated therefore without the pulsator.

Further features, advantages and application possibilities of the present invention will become apparent from the subsequent description of an embodiment illustrated in more detail in the accompanying drawing. It will be understood that any single feature and any combination of single features described and/or represented by illustration form the subject-matter of the present invention, irrespective of their summary in the claims and/or their back-reference.

BRIEF DESCRIPTION OF THE DRAWING

FIG. 1 is a schematic side view of a pulsator according to the present invention for a hair dryer.

DETAILED DESCRIPTION OF THE DRAWING

The pulsator illustrated in the FIG. 1 is constructed in the form of an attachment 1 adapted to be coupled to a hair dryer.

The hair dryer includes a housing accommodating means for generating an air current 2, in particular an electrically powered fan. The air current 2 is discharged from the housing of the hair dryer through a circular opening provided with means for coupling the hair dryer to the attachment 1.

The attachment 1 is of approximately tubular construction and has an inlet opening 3 and an outlet opening 4 at its respective ends. The inlet opening 3 is equipped with a bayonet-type connector 5 for coupling the attachment to the opening of the housing. The attachment 1 is securely joined to the hair dryer by means of the bayonet-type connector 5. Hence the air current 2 exiting from the opening of the hair dryer enters the attachment 1 through the inlet opening 3, flows through the attachment 1 in the attachment longitudinal direction, eventually leaving the attachment 1 through the outlet opening 4.

The attachment 1 contains wall portions bounding an inner compartment 6. These wall portions include two shells 7, 8, a screen 9 and struts 10. These wall portions are constructed so that the inner compartment 6 is rotationally symmetric relative to the longitudinal direction of the attachment 1 and hence to the direction of the air current 2.

The shells 7,8 are of frusto-conical shape. Their diameter thus increases and decreases in the direction of the air current 2. The two shells 7, 8 have their larger diameters solidly joined together. The smaller diameter of the shell 7 forms the inlet opening 3 and is equipped with the bayonet-type connector 5. The smaller diameter of the shell 8 forms the outlet opening 4 of the attachment 1. The shells are made in particularly of heat-resistant plastic and can be transparent in addition.

The screen 9 is of hemispherical construction and, extending from the outlet opening 4, projects into the inner compartment 6 of the attachment 1. It is also possible, of course, for the screen to be of a frusto-conical, paraboloidal or similar configuration. The screen 9 is permeable to air, and the hemispherical form of the screen 9 has a diameter approximately equal to the smaller diameter of the shell 8. The screen 9 is held in an annular retaining member 11 whose diameter is likewise approximately equal to the smaller diameter of the shell 8. The retaining member 11 is arranged in the area of the outlet opening 4 of the attachment 1 so as to be slidable in the direction of the air current 2. In this manner, also the screen 9 is slidable in the longitudinal direction of the attachment 1 and thus in the direction of the air current 2. This is identified by reference numeral 12 in the Figure.

The struts 10 are arranged in the area of the inlet opening 3 approximately transversely to the direction of the air current 2. The struts 10 are arranged in a spaced relationship to each other so as to enable the air current 2 to pass through. They are configured as a circular ring in such a way as to leave an opening for the unimpeded passage of air current 2. The struts 10 may be made of a flexible material. It is also possible, however, for the struts 10 to point radially to the center axis, particularly in a diametrical arrangement in which the circular ring may not be necessary in certain cases. For ease of assembly of the spherical body 13, the struts 10 may be made of a flexible material, in which case the body 13 can be inserted in the inner compartment 6, for example, by means of a suitable tool as a punch or the like, or by hand.

A spherical body 13, in particular a ball or the like, is held captive inside the inner compartment 6. The body 13 has a diameter corresponding approximately to the relative distance of the screen 9 to the struts 10. The diameter of the body 13 is greater than the opening left free by the struts 10. The body 13 is comprised of a heat-resistant material that is as light as possible, for example, plastic. The body 13 can also be colored, using in particular thermochromic lacquers whose color changes with the temperature.

The body 13 is freely movable inside the inner compartment 6. The freedom of movement of the body 13 is limited only by the shells 7, 8, the screen 9 and the struts 10. In the position of the body 13 inside the inner compartment 6 as illustrated in the Figure, the body 13 contacts the screen 9 at a point 14, and the shell 7 at a point 15.

When the hair dryer is switched on, the air current 2 acts on the body 13. This has the result of setting the body 13 in orbital motion. This motion is determined essentially by the screen 9 and the shell 7. The points of contact of the body 13 with the screen 9 and the shell 7 form each a circle passing through the points 14 and 15, with the plane formed by the circles and hence the plane formed by the orbital motion of the body 13 being arranged approximately transversely to the direction of the air current 2.

In this manner, the air current 2 entering through the inlet opening 3 is deflected by the body 13. As a result of the orbital motion of the body 13 inside the inner compartment 6 of the attachment 1, the air current 2 is deflected in rotating and hence pulsating manner.

The velocity of the orbital motion of the spherical body 13 inside the inner compartment 6 of the attachment 1 depends in particular on the dimensioning of the hemispherical screen 9 and on the intensity of the air current 2. With suitable dimensioning, in particular of the diameter of the body 13, it is possible to prevent the air current 2 from encountering an additional, notable flow resistance from the body 13. This has to be taken into account also when dimensioning the mesh size of the screen 9 and the relative distance of the struts 10.

By displacing the screen 9 in the longitudinal direction of the attachment 1 by sliding the retaining member 11, it is possible to vary the points of contact 14 and 15 and hence to vary the orbital motion of the body 13 inside the inner compartment 6 of the attachment 1. When the screen 9 is pushed further into the inner compartment 6 of the attachment 1, the diameter of the orbital motion becomes smaller. With the air current remaining unchanged, this results in an increase in the rotational speed of the body 13. The pulsating frequency of the air current 2 is thus increased. By contrast, when the screen 9 is pushed further out of the inner compartment 6 this results in the diameter of the orbital motion of the body 13 increasing and hence in a slowing down of the pulsating frequency of the air current 2.

Since the air current 2 is typically generated in the hair dryer by a rotating fan, the air current 2 does not enter the attachment 1 in a straight line but in an at least slightly twisting or spiral-type motion. Consequently, the spherical body 13 inside the attachment 1 is incited to the previously described orbital motion by the air current 2 when the hair dryer is switched on.

In the described embodiment of the present invention, the pulsator and the hair dryer are two independent objects which can be coupled together and separated from each other by the bayonet-type connector. The invention may also be implemented so that the pulsator and the hair dryer constitute an integral unit, being accordingly inseparable.

I claim:

1. A pulsator attachment for an air-moving hair care appliance having an air-moving means and an air discharge opening, comprising a housing defining an air inlet opening and an air outlet opening and an air receiving chamber therebetween in communication with said inlet and outlet openings, said air inlet opening being adapted to communicate with said appliance air discharge opening, said chamber being bounded by lateral and at least partially transverse wall portions of said housing between said air inlet and said air outlet openings, and a freely moveable body held captive within the chamber and displaceable by air entering said air inlet, whereby air entering said air inlet opening moves the body and air exiting said air outlet opening is alternately deflected by said moving body.

2. The pulsator as claimed in claim 1, wherein a surface of the moveable body at least partially intersects a surface of a sphere.

3. The pulsator as claimed in claim 1, wherein the position of a center of the body is displaceable within the chamber.

4. The pulsator as claimed in claim 1, wherein the body movement in an approximately orbital path within the chamber.

5. The pulsator as claimed in claim 4, wherein the chamber further comprises a longitudinal axis directed towards the air outlet opening and the orbital path of the body is generally transverse to the longitudinal axis.

6. The pulsator as claimed in claim 1, wherein the chamber further comprises a longitudinal axis directed along the flow of air towards the air outlet opening and the chamber is generally symmetric about said axis.

7. The pulsator as claimed in claim 1, wherein said at least partially transverse wall portions further comprise lower and upper wall portions between said air inlet and air outlet openings, said upper wall portion being proximal said air outlet opening.

8. The pulsator as claimed in claim 1, wherein said at least partially transverse wall portions further comprise a screen defining a plurality of air passages in register with said air outlet opening, said screen at least partially bounding movement of said movable body.

9. The pulsator as claimed in claim 8, wherein said screen extends in a direction from proximal said air outlet opening at least partially inwards towards said chamber.

10. The pulsator as claimed in claim 9, wherein said screen is concave inwards.

11. The pulsator as claimed in claim 10, wherein said screen intersects at least partially a surface of a hemisphere.

12. The pulsator as claimed in claim 8, wherein said screen is moveable between a first position and a second position along an axis directed between said air outlet opening and said air-receiving chamber, wherein at the first position said screen contacts said moveable body along a first displacement pathway having a first length along which said body moves at a first velocity when said chamber receives an inlet air stream, and wherein at the second position said screen contacts said moveable body along a second displacement pathway having a second length less than said first length along which said body moves at a second velocity greater than the first velocity when said chamber receives said inlet air stream, whereby an exit air stream pulsation frequency is greater at said second position than at said first position.

13. The pulsator as claimed in claim 7, wherein said upper wall portion is moveable between a first position and a second position along an axis directed towards said air-receiving chamber, wherein at the first position said upper wall portion contacts said moveable body along a first displacement pathway having a first length along which said body moves at a first velocity when said chamber receives an inlet air stream, and wherein at the second position said upper wall portion contacts said moveable body along a second displacement pathway having a second length less than said first length along which said body moves at a second velocity greater than the first velocity when said chamber receives said inlet air stream, whereby an exit air stream pulsation frequency is greater at said second position than at said first position.

14. The pulsator as claimed in claim 7, wherein said lower wall portion further comprises radially directed ribs, said fibs being proximal said air inlet opening and permitting a passage of air therethrough and blocking an undesired removal of said moveable body from said chamber.

15. The pulsator as claimed in claim 1, wherein said housing wall portions further comprise at least one shell having a surface for contacting said moveable body, said surface at least partially intersecting a truncated cone.

16. The pulsator as claimed in claim 15, further comprising two said shells having their wider regions in opposed relation.

17. The pulsator as claimed in claim 1, wherein said housing further comprises transparent wall portions permitting a user to view the moveable body within said chamber.

18. The pulsator as claimed in claim 17, wherein said moveable body has a color visually contrasting with said transparent wall portions.

19. The pulsator as claimed in claim 17, wherein said moveable body further comprises a thermochromic lacquer, said lacquer indicating a color to a user dependent on temperature.

20. The pulsator as claimed in claim 1, wherein housing wall portions further comprise an interior surface for contacting said moveable body, said interior surface having a flared shape selected from the group of shapes consisting of a trumpet shape and a bell shape.

21. The pulsator as claimed in claim 1 in combination with said air-moving hair care appliance, wherein said pulsator housing at said air inlet opening is integrally formed with said appliance air discharge opening.

22. The pulsator as claimed in claim 1 in removable combination with said air-moving hair care appliance.

23. A pulsator attachment for an air-moving hair care appliance having an air moving means and an air discharge opening, comprising a housing defining an air inlet opening and an air outlet opening and an air receiving chamber therebetween in communication with said inlet and outlet openings, said air inlet opening being adapted to communicate with said appliance air discharge opening, and a moveable body disposed within the chamber, wherein a position of a center of said body is displaceable in response to air entering said air inlet, said chamber further comprising upper and lower wall portions retaining said moveable body within said chamber but not preventing air to flow through said chamber, whereby air entering said air inlet opening moves the body and whereby said moving body alternately deflects an air stream exiting said air outlet opening.

24. The pulsator as claimed in claim 23, wherein said chamber further comprises a pathway on an interior surface of the chamber contacting the moving body and guiding the displacement of said body center position.

25. The pulsator as claimed in claim 23, wherein the displacement of the body comprises an approximately orbital path within the chamber.

26. The pulsator as claimed in claim 24, wherein a portion of said chamber upper wall at least partially comprises said pathway.

27. The pulsator as claimed in claim 26, wherein said upper wall further comprises a screen defining a plurality of air passages in register with said air outlet opening, said screen extending into said chamber.

28. The pulsator as claimed in claim 26, wherein said upper wail is moveable between a first position and a second position along an axis directed towards said air-receiving chamber, wherein at the first position said upper wall contacts said moveable body along a first said displacement pathway having a first length along which said body moves at a first velocity when said chamber receives an inlet air stream, and wherein at the second position said upper wall contacts said moveable body along a second said displacement pathway having a second length less than said first length along which said body moves at a second velocity greater than the first velocity when said chamber receives said inlet air stream, whereby an exit air stream pulsation frequency is greater at said second position than at said first position.

29. The pulsator as claimed in claim 28, wherein said upper wall further comprises a screen defining a plurality of air passages in register with said air outlet opening.

30. The pulsator as claimed in claim 23 in combination with said air-moving hair care appliance.

31. The pulsator as claimed in claim 23, wherein said chamber further comprises a lateral wall portion, and said moveable body is displaced in an orbital relationship in mutually contacting relationship to said lateral wall portion and said upper wall portion.

32. The pulsator as claimed in claim 31, wherein said upper wall portion further comprises a screen defining a plurality of air passages in register with said air outlet opening, said screen intersecting at least partially a surface of a hemisphere, said lateral wall portion being curved in a direction opposite said screen, and a surface of said moveable body intersecting at least partially a surface of a sphere.

* * * * *

UNITED STATES PATENT AND TRADEMARK OFFICE

CERTIFICATE OF CORRECTION

PATENT NO. : 5,689,896

DATED : November 25, 1997

INVENTOR(S) : Norbert Smetana

It is certified that error appears in the above-identified patent and that said Letters Patent is hereby corrected as shown below:

On the title page, after item [22] Filed:, insert -- Foreign Application Priority Data: June 24, 1994 [DE] Germany P 44 22 085.5 --.

Signed and Sealed this

Third Day of February, 1998

Bruce Lehman

BRUCE LEHMAN

*Commissioner of Patents and Trademarks*

*Attest:*

*Attesting Officer*